United States Patent [19]

Jacob

[11] Patent Number: 4,729,433

[45] Date of Patent: Mar. 8, 1988

[54] SAFETY VALVE FOR OIL-WELLS AND INSTALLATION TOOL FOR THE VALVE

[75] Inventor: Jean-Luc Jacob, Lescar, France

[73] Assignee: Diamant Boart France-SA-Division Petrole, Serres Castet, France

[21] Appl. No.: 924,438

[22] Filed: Oct. 29, 1986

[30] Foreign Application Priority Data

Jul. 29, 1986 [FR] France ..... 86 11418

[51] Int. Cl.[4] ..... E21B 34/10

[52] U.S. Cl. ..... 166/322; 166/324

[58] Field of Search ..... 166/319, 321, 322, 324, 166/325, 326, 120

[56] References Cited

U.S. PATENT DOCUMENTS

| | | | |
|---|---|---|---|
| 3,799,258 | 3/1974 | Tunsch | 166/322 |
| 3,865,141 | 2/1975 | Young | 166/322 |
| 4,252,197 | 2/1981 | Pringle | 166/322 |
| 4,294,314 | 10/1981 | Miyagishima et al. | 166/321 |
| 4,432,417 | 2/1984 | Bowyer | 166/322 |
| 4,473,122 | 9/1984 | Tamplen | 166/322 |
| 4,582,134 | 4/1986 | Gano et al. | 166/120 |
| 4,605,070 | 8/1986 | Morris | 166/322 |

FOREIGN PATENT DOCUMENTS

| | | | |
|---|---|---|---|
| 856475 | 12/1960 | United Kingdom | 166/322 |
| 2036134 | 6/1980 | United Kingdom | 166/322 |

*Primary Examiner*—Stephen J. Novosad
*Assistant Examiner*—William P. Neuder
*Attorney, Agent, or Firm*—Harold H. Dutton, Jr.

[57] ABSTRACT

An oil-well safety valve and installing and retrieving tools for the valve, the valve including a movable shutter (11), an internal tubular slide (9), a return spring (10) biasing the slide toward the high position, hydraulic means driving the slide down by pressurizing a control fluid, a system (14) for anchoring the valve in a receiving sleeve (1) and packings (15, 16) in contact with the receiving sleeve (1); the valve including an anchoring system comprising a hydraulically actuated mechanical system including a tubular shuttle piston (58) subjected to the pressure of the control fluid to be moved upward by this fluid, and by a locking bushing (55) located above the shuttle piston for forcing it upwardly, so that when the bushing moves, it actuates and locks anchoring dogs (54) floating in the lock body.

10 Claims, 11 Drawing Figures

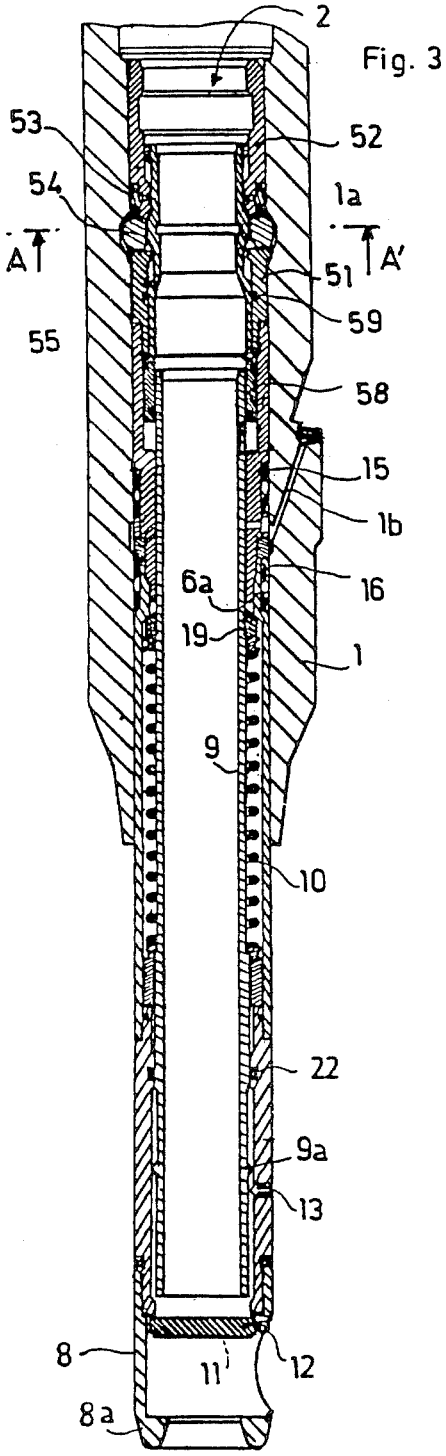
Fig. 3
Fig. 4
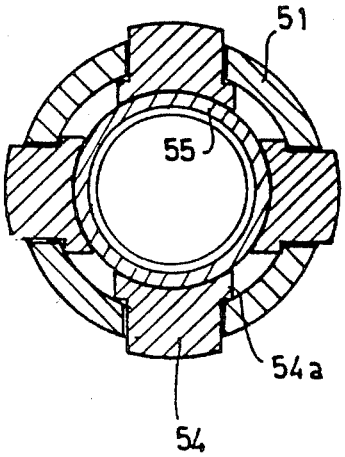

SAFETY VALVE FOR OIL-WELLS AND INSTALLATION TOOL FOR THE VALVE

This invention relates to a safety valve for insertion into an oil-well production pipe to close and open it and thereby control the flow of fluid from the well. The invention also relates to tools for installing and retrieving this valve in order to make this valve operative.

BACKGROUND AND OBJECTS OF THE INVENTION

The purpose of oil-well safety valves is to automatically stop production of well fluid in the event of accident at the wellhead or downstream of it. Such valves are hydraulically controlled from the surface to open, and close automatically by a strong return spring the moment there is a drop, accidential or deliberate, of hydraulic pressure. These valves have been studied extensively for development and improvement, and they are widely used especially in offshore wells.

When being installed, these valves are anchored in a receiving sleeve located inside the production tube. This anchoring is usually by means of anchoring dogs of an elastic nature which can expand radially to enter an anchoring groove of the receiving sleeve. Thereupon these elastic dogs are locked in their anchoring positions by a spring which forces back a latch inside these dogs.

However, the known valves of this type suffer from drawbacks. In the first place, the anchoring procedure is laborious and carried out blindly inside the well without being assured of success at all, as the operator has no means of knowing whether the valve is properly anchored and locked in the receiving sleeve. In case of poor anchoring, the valve cannot withstand the effluent pressure in its closed position, which entails a very serious danger of the well blowing out. Again the known valves provide no assurance that they will open completely after the hydraulic control fluid has been pressurized.

In these known valves, furthermore, the elastic dogs and the latching spring of the anchoring system are immersed in the effluent, i.e. the well fluid, and therefore subjected to its deposition and its corrosiveness.

The primary object of the present invention is to create an improved safety valve free from the above cited drawbacks.

A particular object of the invention is to assure proper valve anchoring when it is being placed in the well.

Another object of the invention is to assure satisfactory valve operation with respect to opening and to permit anchoring only in case of full opening.

Another object of the invention is to permit easy valve retrieval in all cases either normal retrieval for maintenance or emergency retrieval in case of malfunction.

Another object of the invention is to provide a valve of which the anchoring system is free of any elastic part exposed to deposition or corrosion.

To facilitate description, the valve of the invention is assumed in place in an oil well, and the expressions "high", "low", "upper", "lower" will refer to this configuration.

DESCRIPTION OF THE INVENTION

The safety valve of the invention is of the type which comprises a generally tubular valve body, a movable shutter at the lower part of the body and biased toward its closed position and a tubular slide which can slide longitudinally within the valve body in order to cause in its descent the opening of the shutter. A return spring is located in an annular housing between the slide and the valve body so as to bias the slide toward a high position corresponding to the closure of the shutter and hydraulic system is provided for displacing the slide downwardly and including an intake of control fluid through the valve body and a sealed volume between the slide and the body for receiving the control fluid. The slide is provided with a cross-sectional difference which is subjected to the pressure of the fluid contained in the sealed volume so as to be forced downward when the volume is pressurized and an anchoring system is located at the high part of the valve body and designed to fix this valve body in a receiving sleeve itself housed in the production pipe. The system also includes stop means for the valve body in the receiving sleeve and radially movable dogs so as to be able in the stopped position to enter an anchoring groove of the receiving sleeve, and upper and lower packings are placed around the valve body in order to assure tightness at the interface between the valve body and the receiving sleeve below and above the intake of the control fluid.

In the present invention, the valve is characterized by the fact that its anchoring system is stressed hydraulically and comprises mechanical means for actuating and locking the dogs and arranged in such a manner as to be subjected to the pressure of the control fluid contained in the sealed volume and furthermore designed to radially force back the dogs and to lock them in the anchoring groove under the effect of the pressure.

In a preferred embodiment, the actuating and locking means includes a tubular shuttle piston mounted in a sliding manner between two positions, high and low, in the valve body around the high part of the slide. The shuttle piston is designed to offer a surface subjected to the pressure of the control fluid in the sealed volume so as to be forced upward when the volume is pressurized. A locking bushing slides longitudinally in the valve body above the shuttle piston so it may be forced upward by this piston, the bushing having a peripheral cam designed to line up with the dogs and force them back radially when the shuttle piston is in its high position.

Accordingly the dogs are locked by the locking bushing which is displaced toward the locked position by the shuttle piston when the control fluid is pressurized. The anchoring and locking is performed in the absence of any elastic means so that the serious problems of deposition and corrosion affecting the conventional anchoring systems are eliminated. As will be seen further below, such a hydraulically controlled anchoring valve furthermore lends itself to safety procedures which assure proper anchoring and opening of the valve.

In another feature of the invention, the valve body comprises in its upper part a tubular lock body including two tubular parts assembled in extensions of each other by shear screws whereby they may be released. The lower part contains the dogs while the upper part is provided at the top with a hooking shape for an installing tool. Also, in another feature, the locking bushing is provided in its bore with a groove for inserting the retaining dogs provided at the installing tool.

Such a valve can be installed in the well using the installing tool defined below which releases the valve into the receiving sleeve when the control fluid is being pressurized only if there is proper anchoring and locking following complete opening of the valve.

The installing tool includes a conventional tool for lowering the cable and equipped with locks for the valve shape above, as well as with a prong to keep the shutter in the open position. In the present invention, this tool includes a safety device located between the conventional tool and the prong. This safety device is fixed on the conventional tool by a telescoping rod and includes radially retracting retaining dogs with heads that can enter the groove of the locking bushing of the valve and, on the opposite side, heels designed to be housed in the tubular slide of the valve, the retaining dogs on one hand hinge about center shafts biased by spring means for spreading them apart, and on the other hand are acted on by other spring means to bias their heels to spread apart.

The invention furthermore covers a retrieval tool allowing to de-anchor and to raise the valve of the invention. This retrieval tool includes a standard cable lowering tool equipped with hooks engaging the valve shape and further a prong keeping the shutter in the open position. In the present invention this tool includes a rest head located between the standard tool and the prong, the rest head having a lower side which may make contact with the upper end of the valve locking bushing in order to repel downwardly this valve in the course of retrieval.

DESCRIPTION OF THE DRAWINGS

Other features, purposes and advantages of the invention will become apparent in relation to the description below and the accompanying drawings showing in illustrative and non-restrictive manner one embodiment, the drawings being an integral part of this application in which:

FIG. 3 is a view similar to FIG. 1, but showing the valve in a closed position;

FIG. 4 is a sectional view of the valve through the plane AA' of FIG. 3 (the receiving sleeve being omitted from this section for purposes of clarity);

DETAILED DESCRIPTION OF THE INVENTION

Figure 1:
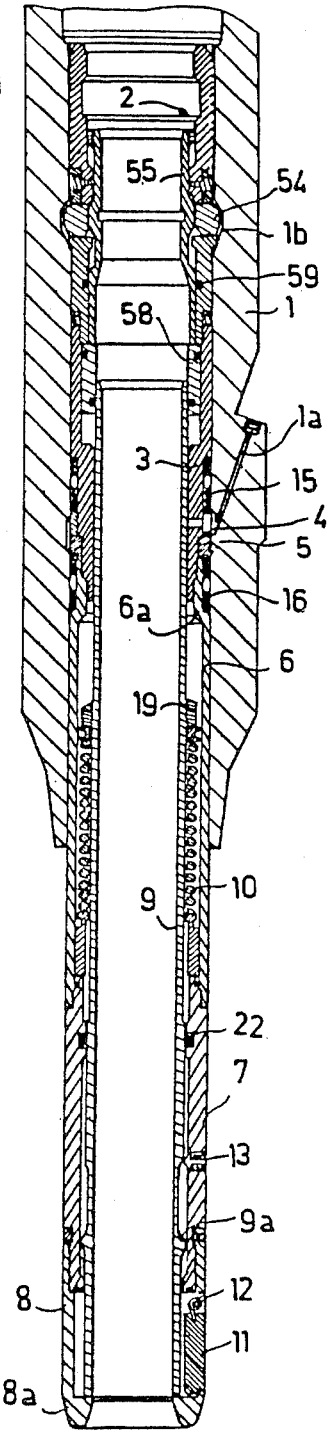
FIG. 1 is a longitudinal sectional view through a vertical plane of a valve of the invention in the open position and anchored in its receiving sleeve.

The safety valve illustratively shown in FIGS. 1 through 4 is adapted for insertion into an oil well production pipe outfitted with a receiving sleeve 1. This receiving sleeve is conventionally provided with a control fluid intake conduit 1*a* and with an anchoring groove 1*b*, the edges of which have a conical shape.

Advantageously the valve may have the overall structure of the improved valve described in the applications entitled "CELL FOR TESTING THE SEALING QUALITY OF AN OIL WELL SAFETY VALVE, A TESTING PROCESS AND VALVE FOR USE THEREIN" of Jean-Luc Jacob; "OIL WELL SAFETY VALVE WITH IMPROVED FLAP" of Jean-Luc Jacob and Jean-Claude Mousques; and "OIL-WELL SAFETY VALVE AND TOOL FOR INSTALLING THE SAME" of Jean-Luc Jacob, all filed on the same date as this application, and the specifications of which are incorporated herein by reference.

This valve comprises a generally tubular valve body comprising of several tubular parts fastened to each other and including an upper lock body 2, upper seal support 3 holding an upper packing 15, tubular spacer 4, locking ring-nut 5, spring case 6 with an upper heel 6*a* holding a lower packing 16, lower bushing 7, and shutter body 8. The seal support 3 and the spacer 4 are perforated by apertures 3*a*, 4*a* to pass the control fluid from the conduit 1*a*.

A tubular slide 9 is mounted inside the valve body and can move longitudinally therein between a lower position (namely the open position) shown in FIG. 1 and the upper position (namely the closed position) shown in FIG. 3. This slide is biased toward its upper position by a return spring 10 and is hydraulically controlled or forced downwardly by the control fluid coming in through the conduit 1*a* when fluid is pressurized.

The shutter body 8 comprises at its lower part a movable shutter, in this example a flap 11, hinging on the body so as to pivot between a retracted (open) position in the side (FIG. 1) and a closed position wherein the flap seals the valve body by resting against a seal on that body (FIG. 3). The flap 11 is biased toward the closed position by a spring 12 mounted about its hinge shaft. The shutter means which is known per se, may be of another type and in particular may be a check ball for which the sealing is achieved by an upper spherical part which would move longitudinally with an associated rotation between an open position and a closed position with a spring biasing the sphere toward the latter position.

Due to the hydraulic control, the slide 9 is moved toward the lower position until it comes to rest against the valve tip 8*a*. Thereupon the slide forces back the shutter 11 and keeps it in the open position. If the pressure of the control fluid drops by accident or design, the return spring 10 will move the slide upward until it is in its high position where it retracts into the lower sleeve 7 (FIG. 3). Thereupon the shutter 11 is released and closes under the action of its spring 12.

The lower sleeve 7 is provided with a balancing or compensating gate 13 which upon reopening, at the beginning of the slide descent, is actuated by a slide cam 9*a* in order to permit balancing the pressures on opposite sides of the shutter 11.

Opposite this shutter, the valve is equipped with a hydraulically driven mechanical anchoring system which in particular is the object of the present invention and which essentially comprises of the lock body 2, anchoring dogs 54, a locking bushing 55 and a shuttle piston 58.

The lock body is threadedly engaged by means of a thread 50 on the contiguous segment of the valve body (comprising the upper seal support 3). The lower end 51*c* forms an internal projection to act as a stop when the shuttle piston 58 is in the upper position.

This lock body comprises two tubular parts, a lower part 51 and an upper part 52, which are assembled in each other's extension by shear screws such as 53. These screws are designed to break at a predetermined shear level in order to release the two parts 51 and 52 and to allow valve retrieval in the event of malfunction, as will be discussed further below.

Figure 2:
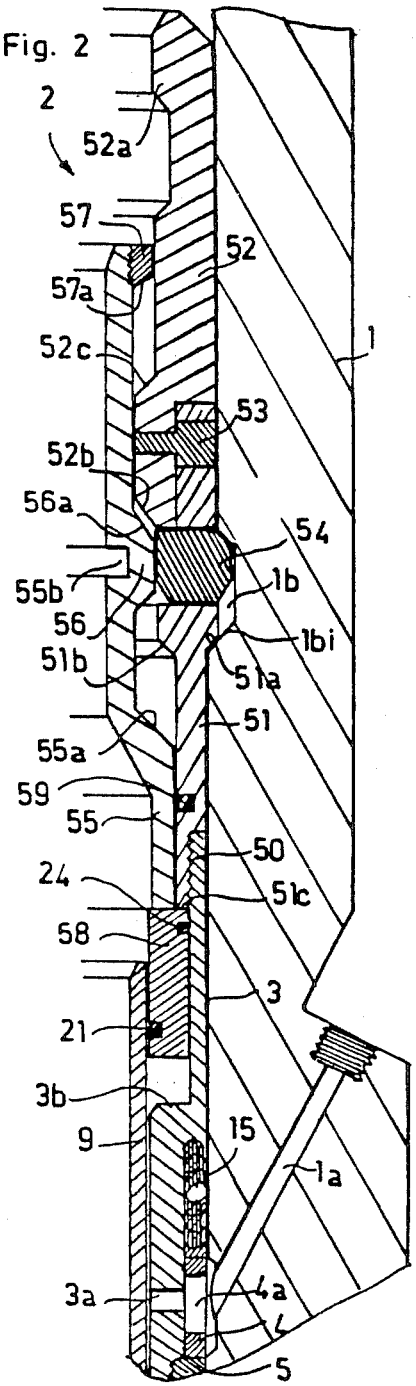
FIG. 2 is an enlarged longitudinal sectional view of a portion of the anchoring system of the valve.
Figure 5:
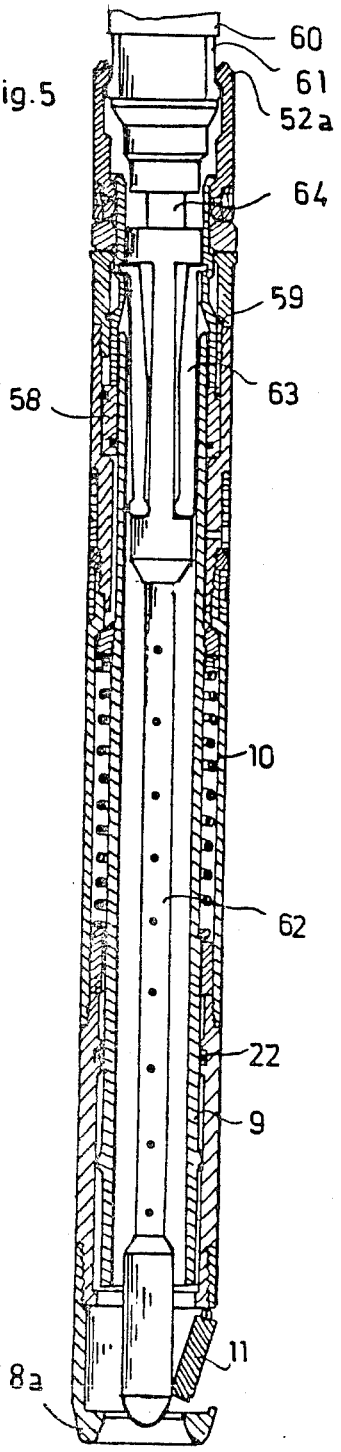
FIG. 5 is a schematic longitudinal sectional view of the valve hooked to an installing tool for anchoring it (the installing tool not being shaded in this view for clarity.
Figure 6:
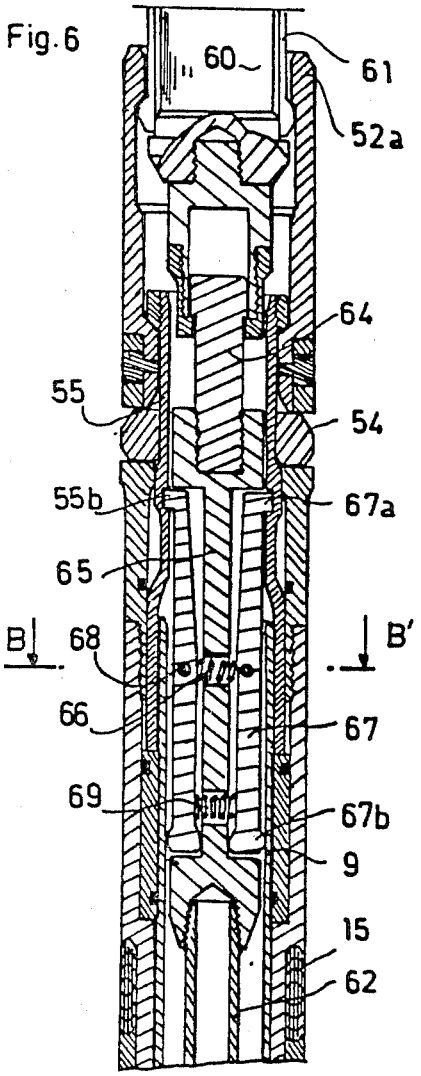
FIG. 6 is a longitudinal sectional view showing the installing tool in further detail.

The lower part 51 is provided with floating dogs 54 housed in its guide apertures. In the example shown in FIG. 4, there are four dogs distributed around the part 51. Each dog is a cube with lower inner and lower and upper outer bevels to allow radial shifting when the locking bushing 55 or the receiving sleeve 1 comes to rest against one of these bevels. Also, shoulders 54*a* on the lateral inside of each detent dog prevent total release outward of each dog while coming to rest against the part 51 of the lock body. Accordingly each dog may project from the lock body as shown in FIGS. 2 and 4 (anchoring position) or on the contrary retract within it (as shown by FIGS. 5 or 6).

The lower part 51 of the lock body comprises a stop shoulder 51*a* located below but near the dogs 54. This shoulder is downwardly frustoconical so as to make contact with the lower conical surface 1*bi* of the anchoring groove 1*b* when the valve has come down into the receiving sleeve 1. Above this shoulder 51*a*, the lock body has a slightly larger diameter than below, the bore of the receiving sleeve 1 assuming conjugate shapes. Accordingly, when the valve is being installed, its descent into the production pipe is stopped when its shoulder 51*a* makes contact with the lower surface 1*bi* of the anchoring groove, the dogs 54 then being opposite this groove.

Also, the lower part 51 of the lock body is provided inside and below the dogs with a hooking shoulder 51*b* having a downwardly directed frustoconical shape. As discussed further below, this shoulder allows hooking the lock bushing 55 to the part 51 when the screws 53 shear.

The upper part 52 of the lock body is provided at the top with a hooking shape 52*a* which allows hooking the valve to an installing tool in a conventional manner when it is being put in place in the production pipe.

This upper part 52 also comprises an inside surface 52*b* in the shape of a downward frustrum of cone and designed to act as the end rest to the locking bushing 55 and to transmit the upward forces applied to the bushing further to the part 52.

Lastly the upper part 52 has an inner shoulder 52*c* in the shape of an upward frustrum of cone to permit hooking the upper part 52 to the lock bushing 55 after the shear screws 53 have broken off.

The radial displacement of the dogs toward their anchoring positions and their locking in this position are assured by the already mentioned lock bushing 55, this bushing being displaced longitudinally for that purpose by the shuttle piston 58.

The locking bushing 55 slides in the lock body with a seal 59 being present at the interface between the bushing and the lower part 51. The bushing is provided with a peripheral cam 56 designed to radially force out the dogs 54 when it arrives at their level. This cam 56 has an upper surface 56*a* in the shape of an upward frustoconical surface so as to permit forcing away the dogs 54 once in contact with them. Furthermore this upper surface 56*a* is designed to come to rest at the end of the travel against the inside surface 52*b* of the upper part 52 of the lock body in order to transmit to it the upward forces applied to the bushing 55.

The locking bushing 55 furthermore is provided with a hooking shoulder 55*a* above its cam 56 and conjugate with the hooking shoulder 51*b* of the part 51 in order to cooperate with the shoulder 51*b* when the screws 53 have sheared off and after the cam 56 has cleared in the upward direction with respect to the dogs 54. The part 51 then is hooked up to the bushing 55.

The locking bushing is provided on its outside and at its upper part with a peripheral hook 57 comprising in this example a ring screwed onto the bushing. This ring has a conical inside surface 57*a* designed to come into contact with the inner shoulder 52*c* of the upper part 52 of the lock body in order to hook the upper part to the bushing after the shear screws 53 have broken.

Lastly, the locking bushing is provided in its bore with a circular groove 55*b*, which during installation in the pipe, allows the installing tool to keep the bushing in place (due to retaining dogs in the tool which are described further below). In this example, this groove 55*b* is present at the level of the cam 56 to make good use of its thickening.

The shuttle piston 58 moving the locking bushing 55 upwardly toward its anchoring position comprises a pipe segment designed to slide in a sealing manner between the valve body (the upper part of the seal support 3) and the upper end of the slide 9. This shuttle piston 58 is provided with an inner seal 21 at the interface between the slide and the shuttle piston and with an outer seal 24 at the interface between the shuttle piston and the valve body. These seals define, at the upper part, the sealed volume containing the control fluid and have different diameters so as to determine an area by which the shuttle piston is subjected to the pressure of the control fluid to displace it upwardly.

The sealed volume containing the control fluid is furthermore defined at the lower part, at the interface between the slide and the valve body, by a lower seal 22, and on either side of the control fluid intake 3*a*, 4*a*, at the interface between the receiving sleeve and the valve body, by packings 15 and 16.

The slide 9 forcing the shutter 11 into its open position has an outer diameter which is larger at the lower seal 22 than at the upper seal 21. Due to this difference in cross-section, this slide is subjected to the pressure of the control fluid which moves it downwardly and compresses its return spring 10.

Therefore, with regard to the valve of the invention, the control fluid acts in the first place on the shuttle piston 58 to bias it upwardly from a low position where it rests against a shoulder 3*b* of the seal support 3 (FIG. 2), toward an upper position where the shuttle piston comes to rest against the projection 51*c* formed by the low end of the part 51 (FIGS. 1 and 2). During this displacement, the shuttle piston forces back the locking bushing 55 whereby the cam 56 will radially actuate the dogs 54 and lock them.

The control fluid also acts on the slide 9 to bias it downward from a high shutter position (FIG. 3) where a ring nut 19 (fixed to the slide to act as a rest for the return spring 10) comes to an upper stop against the heel 6*a* of the spring case, namely toward a low open position (FIG. 1) where the slide comes to rest against the valve tip 8*a*.

As the structure of the valve of the invention has been described in detail, the anchoring and de-anchoring procedures and the corresponding tools will be discussed specifically below, the tools being called installing and retrieving tools, in relation to FIGS. 5 through 11.

FIGS. 5 and 6 show a valve of the invention hooked to an installing tool in order to put it in place in an oil well. The installing tool comprises at its upper part a standard cable lowering tool 60 which is known per se and which is conventionally outfitted on one hand with hooking studs 61 and on the other hand with a lower mandril 62 (often called "prong"). The studs 61 allow suspending the valve by its hooking shape 52*a* from the tool, while the function of the prong 62 is to keep the shutter 11 open during the descent in order to prevent piston phenomena.

The installing tool of the invention is provided with a safety device 63 located between the conventional tool and the prong. This safety device is fixed to the standard tool by a telescoping rod 64 which provides it with the capability of upward longitudinal translation. The safety device includes a central body 65 threadedly at its upper part onto the telescoping rod 64 and holding at its lower part the prong 62 threaded into a conical thread it is provided with. This body 65 has a generally cylindrical shape with two opposite millings acting as seats for two retaining dogs 67 described below, and furthermore has two lateral flat surfaces 65*a* to allow the effluent to pass.

Figure 7:
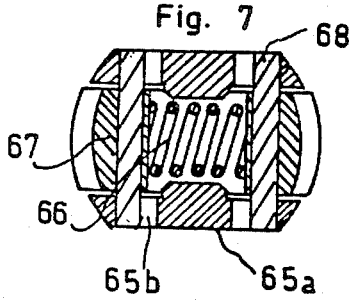
FIG. 7 is a cross-sectional view of the installing tool along lines BB' of FIG. 6 (the valve being omitted)

This body comprises a transverse spring 66 passing through an aperture in this body, with two retaining dogs 67 hinging on the ends of the spring. These dogs therefore are kept in place elastically by the spring 66 which tends to spread them apart, each detent being pivotable about its hinge shaft 68. As shown in FIG. 7, these shafts 68 are guided by slide surfaces 65*b* in the body 65 so as to determine a maximum-spread position when the shafts come to rest against the bottom of the slide surfaces.

Each dog 67 includes at its high part a head 67*a* with a shape fitted to insert into and latch the groove 55*b* of the locking bushing 55 as shown in FIG. 6.

Also, each dog 67 is provided at its lower part with a heel 67*b* designed to be seated in the tubular valve slide 9. Near the heels 67*b*, another spring 69 is located between the two dogs to bias their heels to stay apart.

The valve is put in place by such an installing tool in the following manner:

The valve being unpressurized, its slide 9 is in the high or closed position because of the force exerted by the return spring 10. Also, the shuttle piston 58 and the locking bushing 55 are in the low position, the valve dogs 54 being able to move out of the way. The installing tool is inserted into the valve by it upper orifice, and its retaining dogs 67*a* due to the spring 66, move out of the way at the level of the locking bushing 55. When the studs 61 of the tool hook into the valve hooking shape 52*a*, the retaining dogs 67*a* arrive at the level of the groove 55*b* of this bushing which they enter and latch due to spring 66. This position is schematically shown in FIGS. 5 and 6, and therein the heels 67*b* of the retaining dogs are seated in the valve slide 9 while being forced toward the center, the spring 69 being compressed. Moreover, the prong 62 forces back the shutter 11 which it keeps open.

Thereupon the set is lowered in conventional manner into the oil well until the valve enters the well's receiving sleeve 1 (which generally lies about 150 m below the surface). The actuation force for the packings 15 and 16 is overcome conventionally using a standard slide hooked above the installing tool to impact this tool as a hammer. The floating valve dogs 54 retract at the entry of the receiving sleeve.

Figure 8:
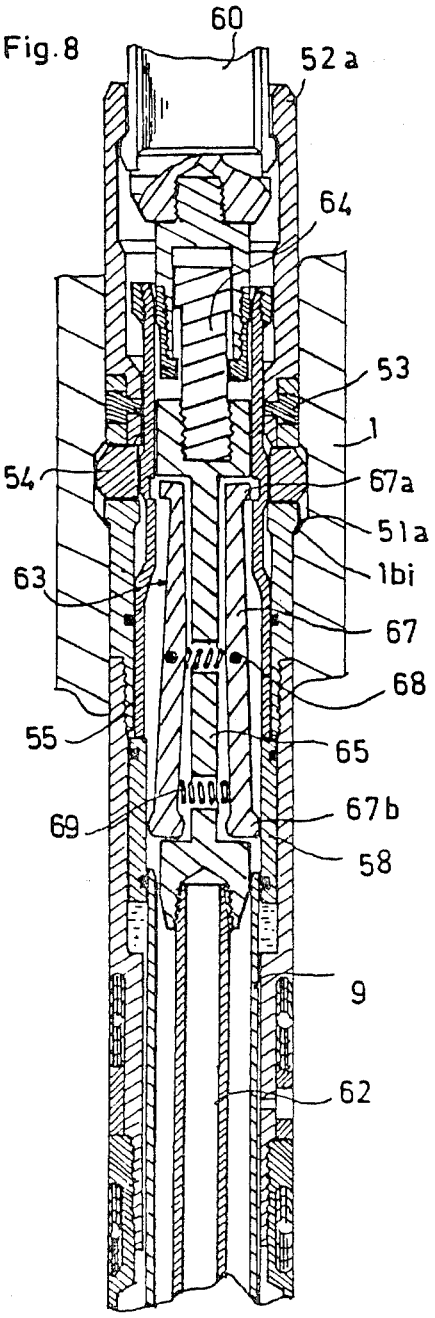
FIG. 8 is a longitudinal sectional view illustrating the normal anchoring operation of the valve before the installing tool is retrieved.

The engagement into the receiving sleeve continues until the valve is stopped by the stop shoulder 1*bi* of the receiving sleeve on which rests the stop shoulder 51*a* of the valve (FIG. 8). Thereupon the control fluid circuit is pressurized and the oil enters the sealed volume previously described and its pressure rises. The shuttle piston 58 of the valve experiences an upward force and rises while forcing back the locking bushing 55 into its high position. In the course of its motion, the bushing actuates the dogs 54 and locks them inside the anchoring groove 1*b* as shown in FIG. 6. The valve is now anchored.

It will be appreciated that while rising, the bushing 55 is constantly hooked to the retaining dogs 67 of the safety device which is displaced upwardly by the motion of the telescoping rod 64.

The hydraulic oil pressure keeps continues to rise until it overcomes the force of the return spring 10. Then, the slide 9 descends until it comes to rest against the valve tip 8*a* and the shutter thereby is forced into the open position: the valve now is open (FIG. 1 position).

At the end of the excursion, the slide 9 releases the heels 67*b* of the tool's retaining dogs and due to the action of the spring 69, these dogs pivot about their hinges 68 and their heads retract toward the center as illustrated by FIG. 8. The locking bushing 55 thereby is released from the installing tool.

Now this installing tool may be retrieved in conventional manner following the conventional release of the hooking studs 61 from the valve hooking shape 52*a*.

It must be emphasized that the installing tool releases the valve by means of the retraction of the retaining dogs 67*a* only after the valve has been anchored and when it is in the fully open position. Otherwise the heels 67*b* of these retaining dogs remain clamped in the slide and their heads 67*a* remain engaged in the valve locking bushing 55.

In case one of the conditions for proper operation is not met (i.e. failure to anchor or defective opening), the valve therefore remains hooked to the installing tool and ascends with it during retrieval. Such a malfunction may have many causes: the packings 15 and 16 may degrade during the descent or the receiving sleeve may be damaged near these packings (preventing pressurization of the fluid sealed volume of the valve), depositions from the effluent in the anchoring groove 1*b*, (preventing the dogs 54 from withdrawing), etc.

Figure 9:
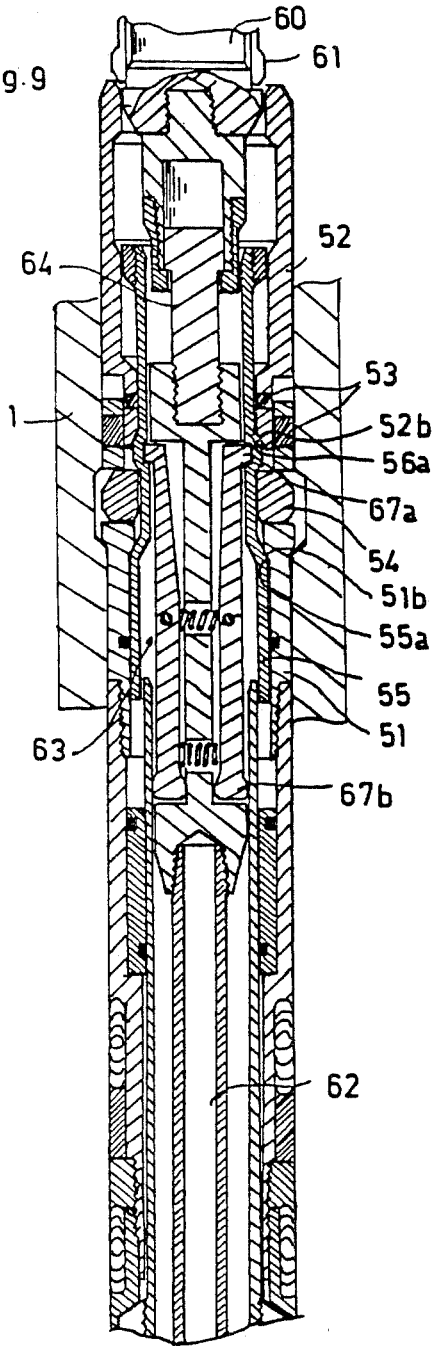
FIG. 9 is a longitudinal sectional view illustrating defective valve operation, where the valve remains hooked to the installing tool for retrieving it.

When there are such malfunctions, the valve retrieval is assured following the release of the tool studs 61 (FIG. 7), by upwardly impacting, using the slide. As the tool's retaining dogs 67 remain hooked to the locking bushing 55, they transmit to this bushing the upward forces and move the upper side 56*a* of its cam to come to rest against the inside surface 52*b* of the upper part 52 of the valve body. As the valve dogs 54 are mechanically forced outward, they form a solid bridge whereby the impacts of the slide act on the shearing screws 53 which thereby break. The now free bushing 55 may rise into the lock body until its hooking shoulder 55*a* comes to rest against the conjugate shoulder 51*a* of the part 51 of the lock body as illustrated by FIG. 9. The dogs 54 are released again and the additional slide impacts cause the valve to rise in the receiving sleeve 1 while the packings 15 and 16 are freed.

Once a valve has been properly anchored in an oil well, this valve may be closed conventionally by a deliberate or accidental drainage of its hydraulic control conduit. Thereupon it moves into the position shown in FIG. 3. The return spring 10, meanwhile has moved the slide 9 upwardly, releasing the shutter 11 which closes on account of its own spring 12 assisted by the well flow.

After the valve is closed, the well fluid no longer flows, but the pressures are balanced above and below the shutter 11 as long as the production pipe is not drained in its upper section. The pressure in this upper section acts on the shuttle piston 58 which descends again into its lower position. However the bushing 55 remains in place due to the hardness of the seal 59.

When the upper segment of the production pipe is being drained, the upstream well pressure is applied to the entire valve cross-section, whereby the valve dogs 54 then rest against the upper conical surface of the anchoring groove 1*b*, so that the bushing 55 is locked more powerfully the higher the well pressure. The valve benefits from self-locking, proportionally to the well pressure.

The valve is opened again by re-pressurizing the hydraulic control conduit, whereby the shuttle piston 58 rises against the bushing 55 and against its stop 51*c* and the opening step takes place as explained above by displacing the slide 9 downwardly be the pressure of the control fluid.

Figure 10:
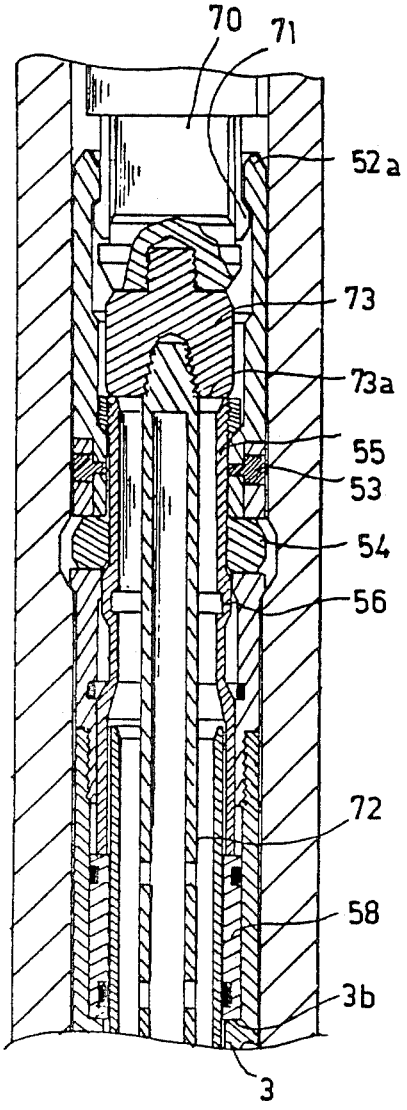
FIG. 10 is a detailed longitudinal sectional view of the valve hooked to a retrieval tool allowing its de-anchoring and retrieval.

The de-anchoring and the retrieval of the valve of the invention may be carried out using a retrieval tool such a diagrammatically shown in FIG. 10. This retrieval tool at its upper part comprises a conventional cable lowering tool 70 identical to the standard tool 60 of the installing tool. This standard tool 70 is provided on one hand with hooking studs 71 designed to cooperate with the valve hooking shape 52*a* and on the other hand comprises a lower prong 72 to keep the shutter 11 open during descent.

The retrieval tool of the invention is provided with a rest head 73 between the standard tool 70 and the prong 72. This head is threaded with a conical thread underneath the standard tool and holds the prong 72 which is turn is threadedly engaged in this head by a conical thread.

The head 73 has a generally cylindrical shape and has a lower side 73*a* to come into contact with the upper end of the valve locking bushing 55. As the hydraulic control conduit is drained, the tool is impacted downwardly using a conventional slide to force the locking bushing 55 down through the rest head 73 and to engage the tool studs 71 into the valve hooking shape 52*a*. The locking bushing descends until it comes to a stop against the shuttle piston 58 itself resting against the shoulder 3*b* of the seal support 3. The valve dogs 54 are then released and can retract inward. Thereupon the tool is subjected to impacts from above and thereby, through the intermediary of the hooking studs 71, causes the packings 15 and 16 to be uncoupled, whereupon the valve is raised by cable.

In case the hydraulic control conduit can not be drained, the valve studs 71 no longer can hook into the valve hooking shape 52*a* because the bushing then would be kept by the pressure in the high position.

In that event, the emergency de-anchoring procedure would be used, whereby, using the above tool, the head 73 is withdrawn (FIG. 11), the prong 72 being directly screwed under the standard tool 70. To that end, the threading of the head 73 is identical with that of the standard tool so that this modified procedure is possible.

Figure 11:
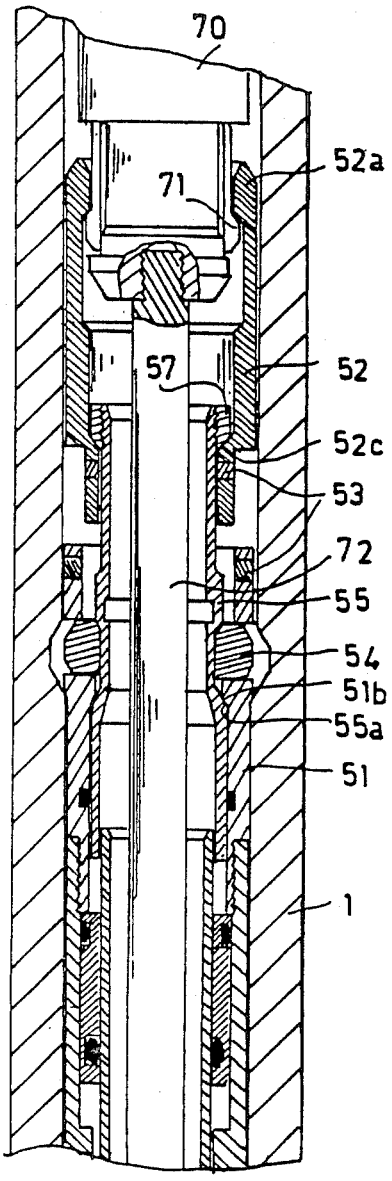
FIG. 11 is a longitudinal sectional view illustrating the emergency de-anchoring of the valve in case it is impossible to drain its hydraulic control circuit.

The tool so modified may hook by its studs 71 into the valve hooking shape 52*a* even if the bushing 55 were locked in its high position. After this hooking has been accomplished, the slide is made to impact upward until the screws 53 are shorn off, as shown in FIG. 11.

Thereupon the upper part 52 of the lock body is released and is raised with the tool 70 until its inner shoulder 52*c* comes to rest against the upper ring 57 of the locking bushing 55. This bushing 55 in turn moves upwardly until its hooking shoulder 55*a* comes to a stop against the conjugate shoulder 51*b* of the lower part 51 of the lock body.

In this position, the valve dogs 54 are released and the entire set may then rise due to the upward impacts of the slide. The packings 15 and 16 are freed from the receiving sleeve 1 and the valve rises in the well. While rising the different lock parts are hooked into each other, the lower part 51 is hooked to the bushing 55, the bushing 55 is hooked to the upper part 52, the upper part 52 is hooked to the tool.

While this invention has been described as having preferred features and embodiments, it will be understood that it is capable of still further modification and adaptation within the spirit of the invention, and this application is intended to cover all variations, adaptations, modifications and alternatives as may fall within the spirit of the invention and the scope of the appended claims.

I claim:

1. A safety valve for insertion into an oil-well production pipe for closing or opening the pipe, said valve comprising a generally tubular valve body, a movable shutter (11) located at the lower part of said valve body and biased toward a closed position, a tubular slide (9) arranged to slide longitudinally inside the valve body for causing by its descending motion the opening of the shutter, a return spring (10) located in an annular housing between the slide and the valve body so as to bias said slide upwardly toward an upper shutter closing position, hydraulic means for displacing said slide downwardly and comprising a control fluid intake (3*a*, 4*a*) through the valve body and a sealed volume between the slide and the body for receiving the control fluid, said slide having a differential cross-section subjected to the pressure of the fluid contained in said sealed volume so as to receive a downward force when said volume is pressurized;

an anchoring system at the upper part of the valve body for securing the valve body into a receiving sleeve (1) in the production pipe, said anchoring system comprising radially movable dogs (54) capable of entering into an anchoring groove (1*b*) of the receiving sleeve, a tubular shuttle piston (58)

slidingly mounted in the valve body and including a surface to be subjected to the pressure of the control fluid in such a manner as to be subjected to an upward force when said control fluid is under pressure; and a lock bushing (55) mounted so as to receive the upward force of said shuttle piston and to be forced upwardly thereby, said lock bushing having a peripheral cam (56) for forcing said dogs into said anchoring groove when said cam (56) reaches the level of said dogs during the travel thereof to an anchoring position; upper and lower seal means (15, 16) arranged around the valve body for sealing the interface between said valve body and the receiving sleeve above and below the control fluid intake;

said shuttle piston (58) being slidingly displaceable in said valve body so as to be freely slidable in said valve body between a lower stop position and an upper stop position, said shuttle piston being only subjected to fluid pressure in the absence of any mechanical blockage along its displacement, said lock bushing (55) being slidingly mounted in said valve body independently of said shuttle piston in such a manner that said shuttle piston only exerts upward pressure on said lock bushing without driving said shuttle piston when said shuttle piston is in said upper stop position, said valve body having on the peripheral surface thereof a stop shoulder (51*a*) adapted to cooperate with said stop means (1*bi*) of said receiving sleeve in said anchoring position, said valve body having a diameter less than the portion of said valve body below said stop shoulder so as to permit the entry of said valve body into said receiving sleeve when said stop shoulder (51*a*) comes into contact against said stop means (1*bi*) of said receiving sleeve.

2. A safety valve as in Claim 1 and including a seal (59) interposed between said lock bushing and said valve body for maintaining said lock bushing in place as a result of its hardness.

3. A safety valve as in claim 1, and wherein said movable dogs (54) comprise a plurality of bevelled cubes distributed in guidance apertures in said lock body, each of said dogs having a shoulder (54*a*) to prevent its complete outward release from the lock body.

4. A safety valve as in Claim 1 and wherein said upper and lower seals (15, 16) are positioned immediately above and below said control fluid inlet entering directly to the interior of said valve body between said valve body and said tubular sleeve (9), said sealed volume containing said control fluid being entirely situated between said valve body and said tubular sleeve, said sealed volume being limited at its upper part by a first gasket (24) on the exterior surface of said shuttle piston at the interface of said shuttle piston (58) and said valve body and by a second gasket (21) of a lesser diameter than said first gasket situated on the internal surface of said shuttle piston (58) at the interface of said shuttle piston and said tubular sleeve, said tubular sleeve (9) having a height such as to at least partially cover said shuttle piston at any relative position of said shuttle piston and said valve body.

5. A safety valve as in claim 1, and wherein said valve body comprises at its upper portion tubular lock body (51, 52) threaded onto a lower contiguous segment (3) of said valve body; said shuttle piston (58) being mounted in sliding manner in said lower contiguous segment (3), the low end (51*c*) of said lock body having on the inside a stop projection for the shuttle piston in its high position; and said locking bushing (55) being mounted in sliding manner in the lock body so as to rest against the upper end of the shuttle piston (58).

6. A safety valve as in claim 3, and wherein said lock body comprises of two tubular parts (51, 52) assembled in each other's extension by shear screws (53) for releasing said parts, the lower part (51) containing said dogs (54) and the upper part (52) having at its top a hooking shape (52*a*) for an installing tool.

7. A safety valve as in claim 6, and wherein said upper part (52) of the lock body includes an inside surface (52*b*) forming a rest for the upper surface (56*a*) of the cam (56) of the locking bushing (55) for transmitting to said upper part the upward forces exerted on the locking bushing.

8. A safety valve as in claim 6 and wherein said locking bushing (55) includes a hooking shoulder (55*a*) below its cam (56); the lower part (51) of the lock body having internally and below the dogs (54) a hooking shoulder (51*b*) conjugate to that of the bushing (55), said hooking shoulders being arranged in such a manner as to cooperate with each other following the upward disengagement of the cam (56) from the dogs (54) in order to accomplish in that position a hooking operation of the lower part (51) onto the bushing (55).

9. A safety valve as in claim 6 and wherein said locking bushing (55) includes externally at its top part a peripheral hooking means (57) designed to come in contact with an internal shoulder (52*c*) in the upper part (52) of the lock body for hooking said upper part to the bushing after said shear screws (53) have ruptured.

10. A safety valve as in claim 1 and wherein said locking bushing (55) includes a groove (55*b*) in its bore for inserting the retaining dogs of an installing tool.

* * * * *